US010593289B2

(12) United States Patent
Ichihashi

(10) Patent No.: US 10,593,289 B2
(45) Date of Patent: Mar. 17, 2020

(54) INFORMATION PROCESSING SYSTEM, IMAGE PROCESSING APPARATUS, IMAGE PROCESSING METHOD, AND PROGRAM FOR COLOR CONVERSION OF AN IMAGE BY SELECTING AN ELECTRICITY CONSUMPTION MINIMUM VALUE

(71) Applicant: SONY CORPORATION, Tokyo (JP)

(72) Inventor: Hideyuki Ichihashi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/620,391

(22) Filed: Feb. 12, 2015

(65) Prior Publication Data

US 2015/0279314 A1 Oct. 1, 2015

(30) Foreign Application Priority Data

Mar. 28, 2014 (JP) ..... 2014-067763

(51) Int. Cl.
*G09G 5/02* (2006.01)
*G09G 5/06* (2006.01)

(52) U.S. Cl.
CPC ..... *G09G 5/02* (2013.01); *G09G 5/026* (2013.01); *G09G 5/06* (2013.01); *G09G 2330/021* (2013.01); *G09G 2340/06* (2013.01); *G09G 2370/10* (2013.01)

(58) Field of Classification Search
None
See application file for complete search history.

(56) References Cited

U.S. PATENT DOCUMENTS

2003/0179945 A1* 9/2003 Akahori ..... G06T 5/20 382/260
2009/0002349 A1* 1/2009 Cok ..... F21K 9/00 345/204
2009/0278470 A1* 11/2009 Baaijens ..... G09G 3/004 315/291
2013/0093783 A1* 4/2013 Sullivan ..... G09G 5/06 345/601

(Continued)

FOREIGN PATENT DOCUMENTS

JP 2005-345678 12/2005
JP 2007-148065 6/2007
JP 2010-139780 6/2010

(Continued)

OTHER PUBLICATIONS

Dec. 26, 2016, JP communication issued for related JP application No. 2014-067763.

(Continued)

*Primary Examiner* — Aaron M Richer
(74) *Attorney, Agent, or Firm* — Paratus Law Group, PLLC

(57) ABSTRACT

An image processing apparatus including a selection section which, by selecting an electricity consumption minimum value where electricity consumption of a display section, which performs a display based on a value out of a plurality of values which are present within a predetermined distance from a pixel value of an image in a uniform color space, is a minimum as a pixel value of the image after color conversion, generates an image after the color conversion.

15 Claims, 10 Drawing Sheets

(56) References Cited

U.S. PATENT DOCUMENTS

2015/0029210 A1* 1/2015 Daly ..... G09G 5/02
345/591

FOREIGN PATENT DOCUMENTS

| | | | |
|---|---|---|---|
| JP | 2011-002520 | | 1/2011 |
| JP | 2011-118319 | | 6/2011 |
| JP | 2011-227257 | | 11/2011 |
| JP | 2013-104912 | | 5/2013 |
| WO | WO2006/049058 | A1 | 5/2006 |
| WO | WO2013/142067 | A1 | 9/2013 |

OTHER PUBLICATIONS

Jul. 3, 2018, Chinese Office Action issued for related CN Application No. 201510124662.4.

* cited by examiner

INFORMATION PROCESSING SYSTEM, IMAGE PROCESSING APPARATUS, IMAGE PROCESSING METHOD, AND PROGRAM FOR COLOR CONVERSION OF AN IMAGE BY SELECTING AN ELECTRICITY CONSUMPTION MINIMUM VALUE

CROSS REFERENCE TO RELATED APPLICATIONS

This application claims the benefit of Japanese Priority Patent Application JP 2014-067763 filed Mar. 28, 2014, the entire contents of which are incorporated herein by reference.

BACKGROUND

The present disclosure relates to an image processing apparatus, an image processing method, and a program and particularly relates to an image processing apparatus, an image processing method, and a program where it is possible to keep deterioration in the appearance of an image in a predetermined range in a case of reducing electricity consumption when displaying an image using color conversion.

Techniques which reduce electricity consumption in a display are particularly important for the long-term use of battery-driven mobile devices such as smart phones and tablet terminals. As a technique which reduces the electricity consumption of a liquid crystal display (LCD), there is a technique which, by approaching an observation value using the integration of a luminance value and the luminance of a back light, reduces the luminance of the back light as much as possible (for example, refer to Japanese Unexamined Patent Application Publication No. 2013-104912). However, this technique may not be applied to a self-luminous display such as an organic light-emitting diode (OLED) display.

As a technique which reduces the electricity consumption of a self-luminous display, there is a technique which reduces luminance by uniformly multiplying a gain by the luminance of an image, a technique which reduces luminance according to features of an image (for example, refer to Japanese Unexamined Patent Application Publication No. 2011-2520), and the like. In addition, as a technique which reduces the electricity consumption of a self-luminous display, there is also a technique which converts the colors of an image (for example, refer to Japanese Unexamined Patent Application Publication Nos. 2011-227257 and 2007-148065).

SUMMARY

However, in the techniques according to Japanese Unexamined Patent Application Publication Nos. 2011-227257 and 2007-148065, qualitative influences due to changes in the colors (influence on the appearance (visibility)) are not sufficiently considered and there is a possibility that the appearance of the image after color conversion will be remarkably deteriorated.

The present disclosure is able to keep deterioration in an appearance of an image in a predetermined range in a case of reducing electricity consumption when displaying an image using color conversion.

An image processing apparatus of a first embodiment of the present disclosure is an image processing apparatus including a selection section which selects an electricity consumption minimum value where electricity consumption of a display section, which performs a display based on a value out of a plurality of values which are present within a predetermined distance from a pixel value of an image in a uniform color space, is a minimum as a pixel value of the image after color conversion, to generate an image after the color conversion.

An image processing method and a program of the first embodiment of the present disclosure correspond to the image processing apparatus of the first embodiment of the present disclosure.

In the first embodiment of the present disclosure, an image after the color conversion is generated by an electricity consumption minimum value where electricity consumption of a display section, which performs a display based on a value out of a plurality of values which are present within a predetermined distance from a pixel value of an image in a uniform color space, is a minimum being selected as a pixel value of the image after color conversion.

An image processing apparatus of a second embodiment of the present disclosure is an image processing apparatus including a conversion section which performs color conversion of an image by converting a pixel value of each pixel of the image into an electricity consumption minimum value which corresponds to the pixel value based on a table where an electricity consumption minimum value where electricity consumption of a display section, which performs a display based on a value out of a plurality of values which are present within a predetermined distance from a predetermined value in a uniform color space, is a minimum is associated with the predetermined value.

An image processing method and a program of the second embodiment of the present disclosure correspond to the image processing apparatus of the second embodiment of the present disclosure.

In the second embodiment of the present disclosure, color conversion of the image is performed by a pixel value of each pixel of the image being converted into an electricity consumption minimum value which corresponds to the pixel value based on a table where an electricity consumption minimum value where electricity consumption of a display section, which performs a display based on a value out of a plurality of values which are present within a predetermined distance from a predetermined value in a uniform color space, is a minimum is associated with the predetermined value.

According to the first and second embodiments of the present disclosure, it is possible to perform color conversion of an image. In addition, according to the first embodiment of the present disclosure, it is possible to keep deterioration in the appearance of an image in a predetermined range in a case of reducing electricity consumption when displaying an image by color conversion.

Here, the effects described here are not necessarily limited and may be any of the effects described in the present disclosure.

DETAILED DESCRIPTION OF EMBODIMENTS

Below, description will be given of the premise of the present disclosure and forms (referred to below as embodiments) for realizing the present disclosure. Here, description will be given in the following order.

1. First Embodiment: Image Processing Apparatus (FIG. 1 to FIG. 4)
2. Second Embodiment: Image Processing Apparatus (FIG. 5 and FIG. 6)
3. Third Embodiment: Computer (FIG. 7)
4. Fourth Embodiment: Television Apparatus (FIG. 8)
5. Fifth Embodiment: Mobile Phone (FIG. 9)
6. Sixth Embodiment: Recording and Play-back Apparatus (FIG. 10)
7. Seventh Embodiment: Imaging Apparatus (FIG. 11)

First Embodiment

Configuration Example of First Embodiment of Image Processing Apparatus

Figure 1:
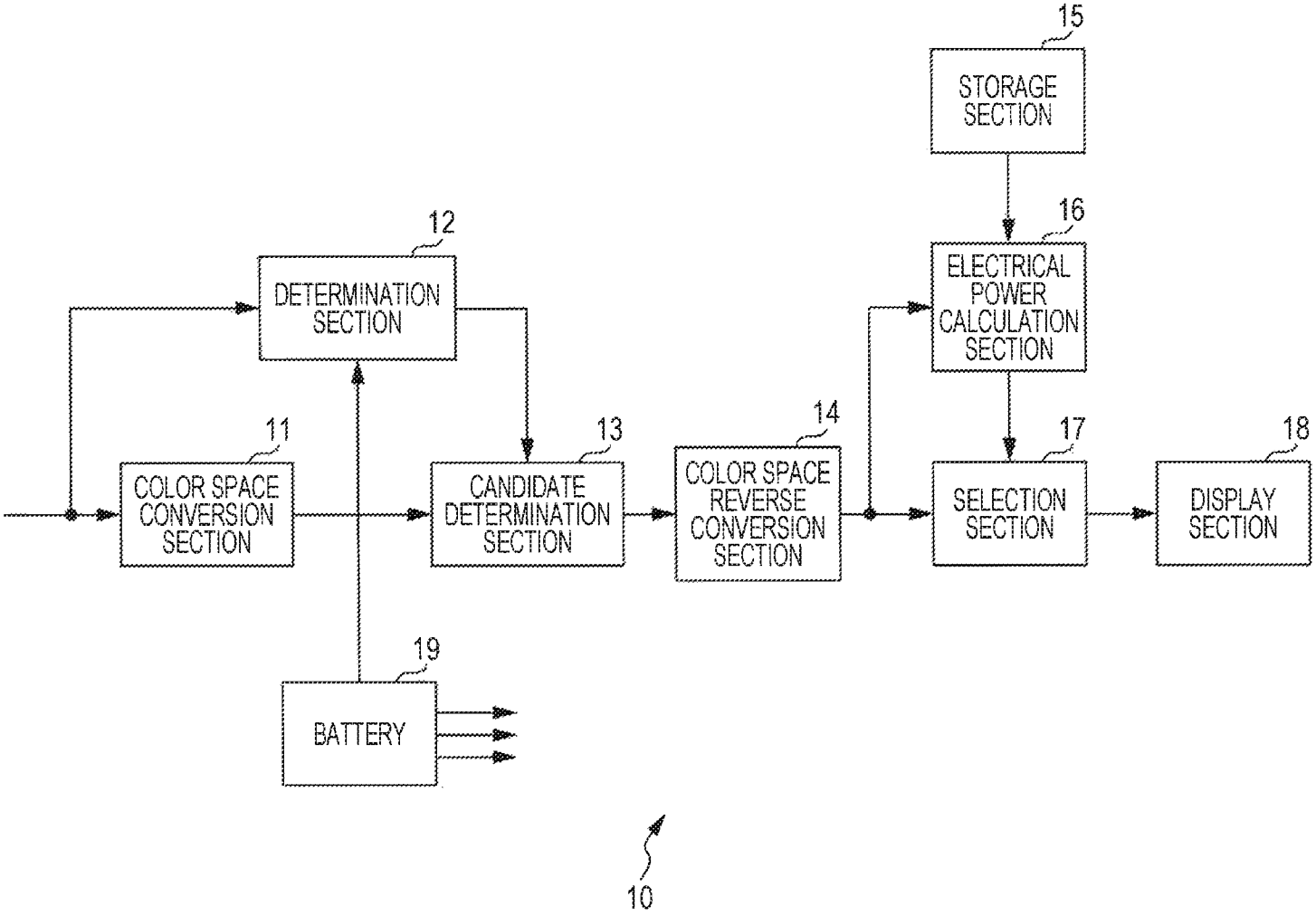
FIG. 1 is a block diagram which shows a configuration example of a first embodiment of an image processing apparatus to which the present disclosure is applied.

FIG. 1 is a block diagram which shows a configuration example of a first embodiment of an image processing apparatus to which the present disclosure is applied.

An image processing apparatus 10 in FIG. 1 is configured by a color space conversion section 11, a determination section 12, a candidate determination section 13, a color space reverse conversion section 14, a storage section 15, an electrical power calculation section 16, a selection section 17, a display section 18, and a battery 19. The image processing apparatus 10 reduces electricity consumption of the battery 19 by performing color conversion with respect to an image.

In detail, the color space conversion section 11 of the image processing apparatus 10 converts a color space of an RGB value, which is a pixel value of an RGB space of each pixel of an image (referred to below as an input image) which is input from outside, into a perception uniform color space such as L*a*b* color space. The color space conversion section 11 supplies a pixel value (referred to below as a uniform pixel value) of the perception uniform color space of each pixel of the input image which is obtained as a result to the candidate determination section 13.

The determination section 12 determines a distance (Euclidean distance) ΔE between a candidate of a uniform pixel value of an input image after color conversion and a uniform pixel value of an input image before color conversion in a perception uniform color space, that is, an allowable color variation amount for each pixel of the input image based on an operation mode of the image processing apparatus 10 and a residual amount of the battery 19. The operation mode of the image processing apparatus 10 is set, for example, by a user operating an operation section or the like which is not shown in the diagram. As the operation mode, there is a normal mode which reduces electricity consumption of the battery 19 according to the residual amount of the battery 19, an economy mode which reduces electricity consumption of the battery 19 regardless of the residual amount of the battery 19, and the like.

In a case where the operation mode is the normal mode, the determination section 12 determines the distance ΔE so as to be longer as the residual amount of the battery 19 is smaller. In a case where the operation mode is an economy mode, the determination section 12 determines a comparatively long distance which is set in advance as the distance ΔE.

The determination section 12 obtains a distance ΔE' where the appearance is considered more in depth by correcting (normalizing) the distance ΔE of each pixel which is determined based on features of the input image. In detail, for example, since changes in color are easily seen with a blue color, in a case where a color represented by an RGB value of the input image is a blue color, the determination section 12 decreases the distance ΔE of a pixel which corresponds to this RGB value and sets the distance as the distance ΔE'.

In addition, deterioration in the appearance due to color conversion in an image where a local spatial frequency is high is not easily seen. Accordingly, the determination section 12 calculates, for example, a spatial frequency in a region centering on each pixel of the input image based on the RGB values of the input image and, in a case where the spatial frequency is high, increases the distance ΔE of a pixel which corresponds to the spatial frequency and sets the distance as the distance ΔE'. The determination section 12 supplies the distance ΔE' to the candidate determination section 13.

Here, the correction of the distance ΔE may be performed based on a uniform pixel value and not the RGB value of the input image.

The candidate determination section 13 determines a plurality of values which are present within the distance ΔE' from a uniform pixel value which is supplied from the color space conversion section 11 in the perception uniform color space as a candidate of the uniform pixel value of the input image after color conversion for each pixel. Here, a value in a case where a distance ΔE' is 0, that is, a uniform pixel value of an input image before color conversion which is supplied from the color space conversion section 11 is included in candidates of the uniform pixel value of the input image after color conversion. The candidate determination section 13 supplies a determined candidate of a uniform pixel value of the input image after color conversion to the color space reverse conversion section 14.

The color space reverse conversion section 14 converts the color space of a candidate of a uniform pixel value of each pixel of the input image after color conversion which is supplied from the candidate determination section 13 into RGB space. The color space reverse conversion section 14 supplies an RGB value of each pixel which is obtained as a result to the electrical power calculation section 16 and the selection section 17 as a candidate of an KGB value of each pixel of the input image after color conversion.

The storage section 15 stores electricity consumption information which represents a relationship between an KGB value and electricity consumption of the display section 18 which performs a display based on the KGB value as an electrical power model. The electrical power model varies according to the display section 18.

The electrical power calculation section 16 reads out the electricity consumption, which corresponds to a candidate of the RGB value of each pixel of the input image after color conversion which is supplied from the color space reverse conversion section 14, from the electrical power model which is stored in the storage section 15. The electrical power calculation section 16 supplies the electricity consumption of a candidate of the RGB value of each pixel of the input image after color conversion to the selection section 17.

The selection section 17 selects an RGB value (an electricity consumption minimum value) where the electricity consumption is the minimum out of candidates of an RGB value of each pixel of an input image after color conversion based on electricity consumption of a candidate of an RGB value of the input image after color conversion which is supplied from the electrical power calculation section 16, as an RGB value of each pixel of an input image after color conversion, for each pixel. Due to this, an RGB value of each pixel of the input image after color conversion where electricity consumption of the display section 18 is reduced is generated and supplied to the display section 18.

The display section 18 is, for example, a self-luminous display such as an OLED display. The display section 18 displays the input image after color conversion based on the RGB values of each pixel of the input image after color conversion which is supplied from the selection section 17.

The battery 19 supplies electrical power to each section.

Here, the display section 18 may be provided outside the image processing apparatus 10 as a display apparatus. In this case, since the electrical power model which corresponds to the image processing apparatus 10 is not uniquely determined, an acquiring section which acquires an electrical power model from a display apparatus is provided instead of the storage section 15. In addition, the battery which supplies electrical power to the display apparatus is not the battery 19, but a battery which is provided in the display apparatus.

Figure 2:
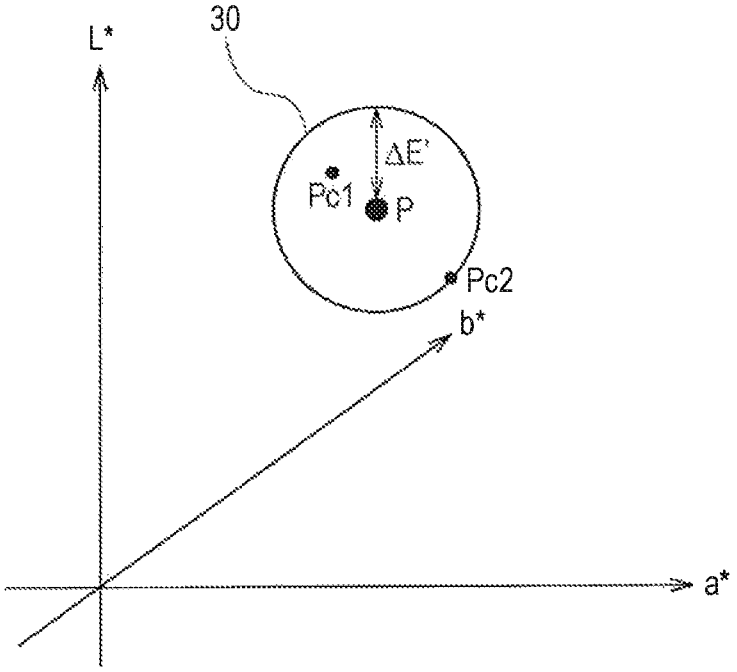
FIG. 2 is a diagram which shows an example of a candidate of a uniform pixel value of an input image after color conversion.

Example of Candidate of Uniform Pixel Value of Input Image after Color Conversion FIG. 2 is a diagram which shows an example of a candidate of a uniform pixel value of the input image after color conversion.

Here, in the example in FIG. 2, the perception uniform color space is an L*a*b* color space.

As shown in FIG. 2, in the L*a*b* color space, candidates of a uniform pixel value of the input image after color conversion are present in a sphere 30 whose radius centering on a uniform pixel value P of the input image before color conversion is a distance ΔE' (including on the sphere 30). In the example in FIG. 2, candidates of a uniform pixel value of the input image after color conversion are a uniform pixel value P of the input image before color conversion, a value Pc1 which is separated from the uniform pixel value P by a distance which is shorter than the distance ΔE', and a value Pc2 which is separated from the uniform pixel value P by the distance ΔE'.

The perception uniform color space is a space which is designed such that distances and intervals in the color space are similar to distances and intervals of perceived colors. Accordingly, in the perception uniform color space, it is possible to quantitatively evaluate the size of differences in the appearance between colors by the distance between the colors, that is, a color difference. In detail, the shorter the distance between the colors, the smaller the difference in the appearance between colors.

Accordingly, a difference in the appearance between a color which corresponds to a candidate of a uniform pixel value of an input image after color conversion which is present in the sphere 30 where a distance from a uniform pixel value P is a distance ΔE' or less and a color which corresponds to the uniform pixel value P is within a predetermined range.

In addition, a degree of deterioration in the appearance of the input image after color conversion is determined by the distance ΔE'. Accordingly, it is possible to suppress deterioration in the appearance by reducing the distance ΔE'; however, since the range of values which are able to be candidates of the uniform pixel value of the input image after color conversion is narrowed, the degree of reduction in the electricity consumption is decreased. In addition, the degree of deterioration in the appearance is increased by increasing the distance ΔE'; however, since the range of values which are able to be candidates of the uniform pixel value of the input image after color conversion is widened, the degree of reduction in the electricity consumption is increased.

Description of Processing of Image Processing Apparatus

Figure 3:
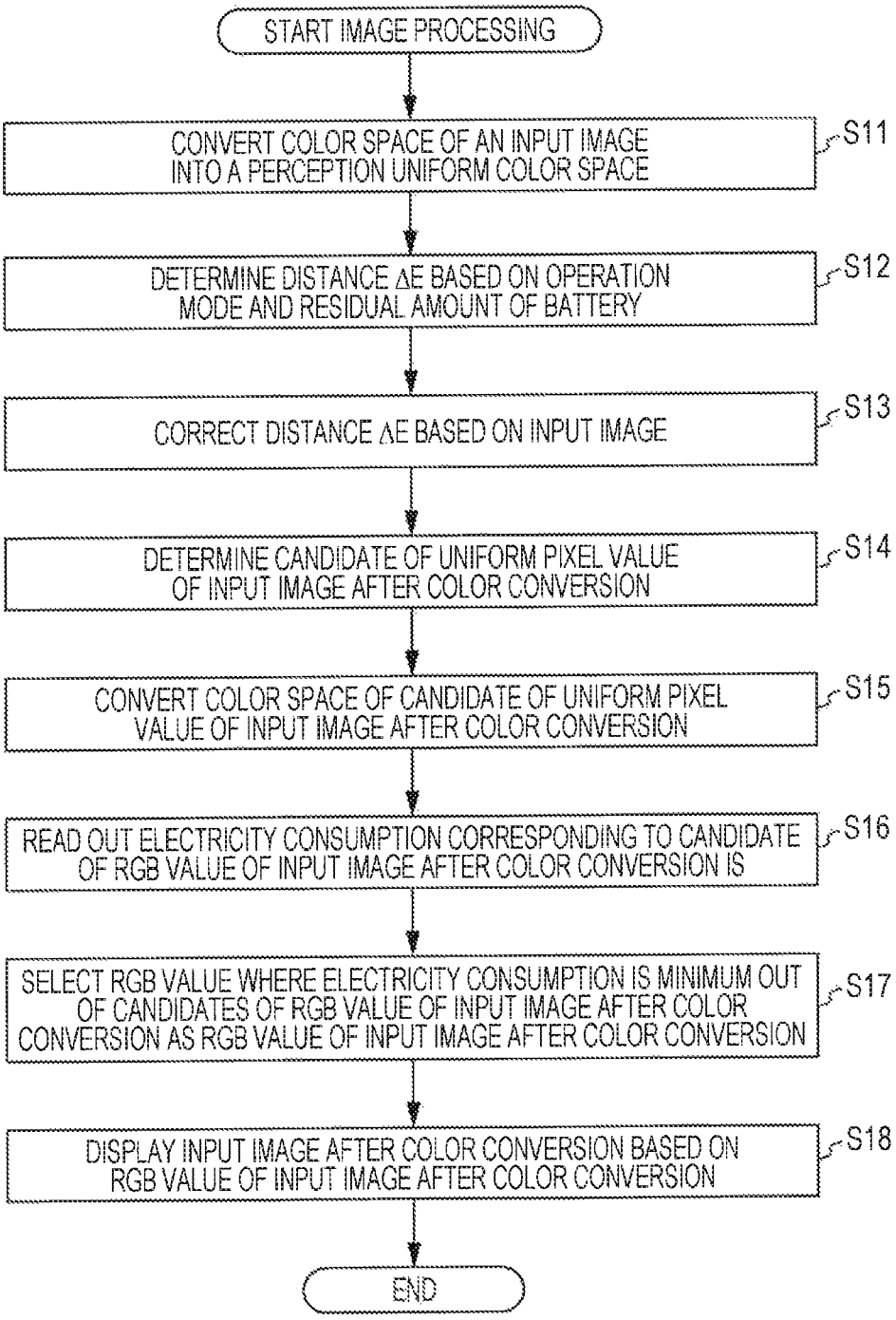
FIG. 3 is a flowchart which illustrates image processing of the image processing apparatus in FIG. 1.

FIG. 3 is a flowchart which illustrates image processing of the image processing apparatus 10 in FIG. 1. The image processing starts, for example, when the input image is input to the image processing apparatus 10.

The processes in steps S11 to S17 in FIG. 3 are performed for each pixel of the input image. In step S11, the color space conversion section 11 of the image processing apparatus 10 converts color space of an RGB value of the input image into a perception uniform color space and supplies a uniform pixel value which is obtained as a result to the candidate determination section 13.

In step S12, the determination section 12 determines the distance ΔE based on the operation mode of the image processing apparatus 10 and the residual amount of the battery 19. In step S13, the determination section 12 corrects the distance ΔE which is determined in step S12 based on the input image and generates the distance ΔE'. The determination section 12 supplies the distance ΔE' to the candidate determination section 13.

In step S14, the candidate determination section 13 determines a plurality of values which are present within the distance ΔE' from a uniform pixel value in the perception uniform color space as a candidate of the uniform pixel value of the input image after color conversion and supplies the plurality of values to the color space reverse conversion section 14.

In step S15, the color space reverse conversion section 14 converts color space of a candidate of a uniform pixel value of the input image after color conversion which is supplied from the candidate determination section 13 into RGB space. The color space reverse conversion section 14 supplies an RGB value which is obtained as a result to the electrical power calculation section 16 and the selection section 17 as a candidate of an RGB value of the input image after color conversion.

In step S16, the electrical power calculation section 16 reads out the electricity consumption which corresponds to a candidate of an RGB value of the input image after color conversion, which is supplied from the color space reverse conversion section 14, from an electrical power model which is stored in the storage section 15. The electrical power calculation section 16 supplies the electricity consumption of a candidate of an RGB value of the input image after color conversion to the selection section 17.

In step S17, the selection section 17 selects an RGB value where electricity consumption is the minimum out of candidates of an RGB value of the input image after color conversion based on the electricity consumption of a candidate of an RGB value of the input image after color conversion which is supplied from the electrical power calculation section 16, as an RGB value of the input image after color conversion. The selection section 17 supplies an RGB value of the input image after color conversion to the display section 18.

In step S18, the display section 18 displays the input image after color conversion based on an RGB value of each pixel of the input image after color conversion which is supplied from the selection section 17 by the processes in steps S11 to S17 being performed with regard to each pixel of the input image. Then, the process ends.

As described above, the image processing apparatus 10 selects an RGB value of a candidate where the electricity consumption of the display section 18 is the minimum out of candidates of a uniform pixel value of the input image after color conversion which are present within a distance ΔE' from a uniform pixel value of the input image before color conversion in a uniform color space as an RGB value of the input image after color conversion. Accordingly, it is possible to keep deterioration in the appearance of the input image in a predetermined range in a case of reducing the electricity consumption when displaying the input image using color conversion.

In addition, the image processing apparatus 10 performs color conversion based on the distance ΔE' which becomes shorter in a case where a color represented by an RGB value of each pixel of an input image is a blue color, rather than the distance ΔE. Accordingly, the image processing apparatus 10 is able to suppress deterioration in the appearance of a region where deterioration in the appearance of the input image after color conversion stands out and to improve the appearance of the input image after color conversion compared to a case of performing color conversion using the distance ΔE.

In addition, the image processing apparatus 10 performs color conversion based on the distance ΔE' which becomes longer in a case where a local spatial frequency is high, rather than the distance ΔE. Accordingly, the image processing apparatus 10 is able to reduce the electricity consumption when displaying a region where deterioration in the appearance of the input image after color conversion does not stand out, compared to a case of performing color conversion using the distance ΔE.

Figure 4:
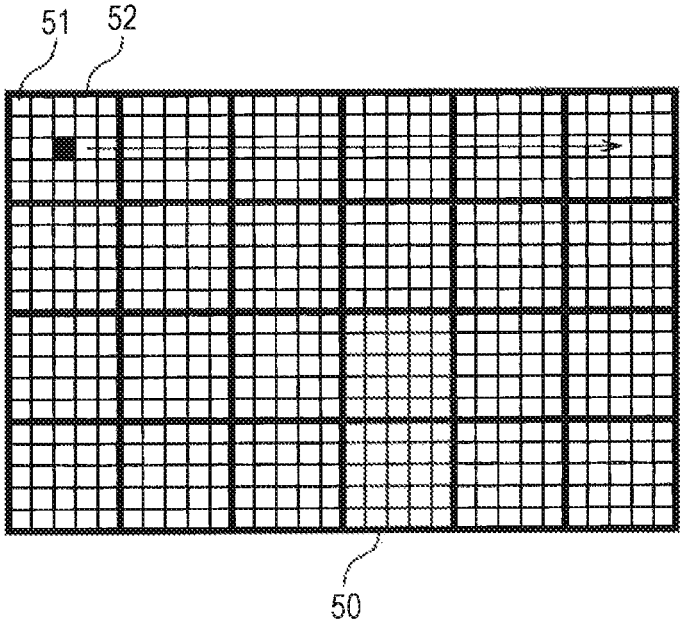
FIG. 4 is a diagram which shows an example of a block.

Here, in the description described above, the determination section 12 determines the distance ΔE' for each pixel; however, the distance ΔE' may be determined in a block unit formed of a plurality of pixels. In this case, for example, as shown in FIG. 4, an input image 50 is divided into a block 52 formed of 5×5 pixels 51. Then, the distance ΔE of the 5×5 pixels 51 which are included in the block 52 is corrected based on features of the block 52.

In detail, in a case of correcting the distance ΔE based on colors of the input image 50, for example, the determination section 12 corrects distances ΔE of all of the pixels 51 which are included in the block 52 based on a color represented by the RGB value of the pixel 51 in the center of the block 52.

In addition, in a case of correcting the distance ΔE based on a local spatial frequency of the input image 50, the determination section 12 calculates a spatial frequency of a region centering on the pixel 51 in the center of the block 52 in the block 52 unit. Then, the determination section 12 corrects the distances ΔE of all of the pixels 51 which are included in the block 52 based on the calculated spatial frequency. Accordingly, the determination section 12 is able to reduce processing costs by determining the distance ΔE' in block units compared to a case of determining the distance ΔE' in pixel units.

In the example in FIG. 4, the size of the block 52 is set as 5×5 pixels; however, the size of the block 52 is not limited thereto. The larger the size of the block 52, the more the processing cost is reduced; however, since reduction in the processing costs and deterioration in the appearance of the input image after color conversion have a trade-off relationship, determination is carried out while considering the allowable range of deterioration in the appearance of the input image after color conversion.

In addition, in the description above, the pixel values of the input image are RGB values; however, the pixel values may be RGBW values. In this case, the display section 18 is a RGBW type display and, in the electrical power model, smaller electricity consumption is associated with respect to RGBW values of colors (neutral colors) which put weight on W which has good light emitting efficiency.

Second Embodiment

Configuration Example of Second Embodiment of Image Processing Apparatus

Figure 5:
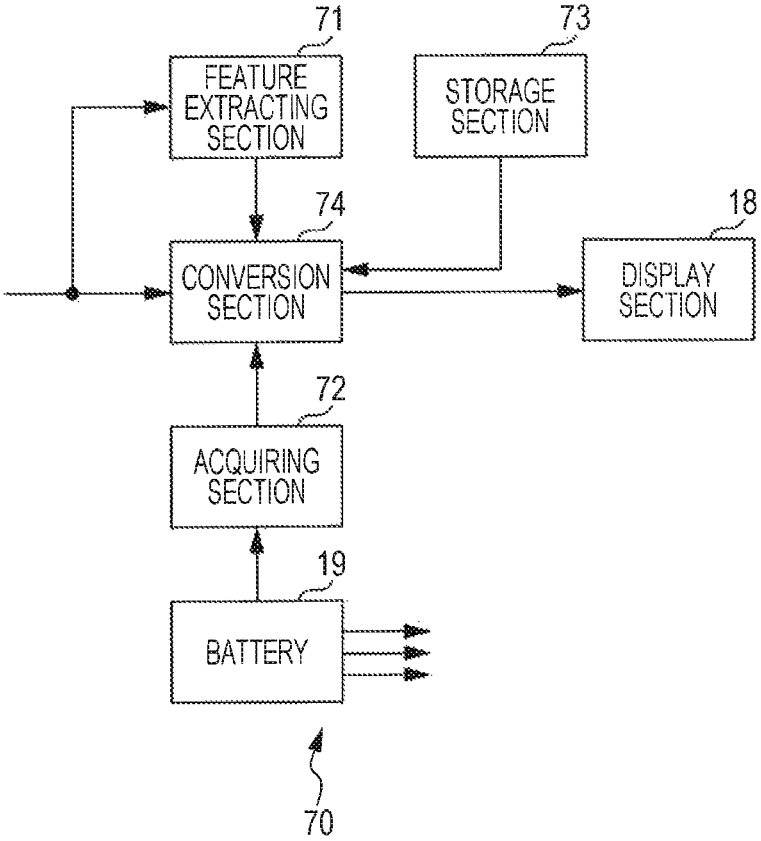
FIG. 5 is a block diagram which shows a configuration example of a second embodiment of an image processing apparatus to which the present disclosure is applied.

FIG. 5 is a block diagram which shows a configuration example of a second embodiment of an image processing apparatus to which the present disclosure is applied.

In the configuration shown in FIG. 5, the same reference numerals are given where the configuration is the same as the configuration in FIG. 1. Overlapping description will be appropriately omitted.

An image processing apparatus 70 in FIG. 5 is configured by a feature extracting section 71, an acquiring section 72, a storage section 73, a conversion section 74, the display section 18, and the battery 19. The image processing apparatus 70 performs color conversion based on a look up table (LUT) where RGB values before and after color conversion which is performed in the image processing apparatus 10 are associated.

In detail, the feature extracting section 71 of the image processing apparatus 70 calculates a spatial frequency in a region centering on the pixel for each pixel based on the RGB value of each pixel of the input image. The feature extracting section 71 determines that the spatial frequency is high in a case where the calculated spatial frequency is a predetermined threshold or more and that the spatial frequency is low in a case where the calculated spatial frequency is smaller than a predetermined threshold. The feature extracting section 71 supplies information which represents the rise and fall of the spatial frequencies of each pixel to the conversion section 74 as feature information which represents a feature of the input image.

The acquiring section 72 acquires the current operation mode of the image processing apparatus 70. The operation mode is the same as the operation mode of the image processing apparatus 10 and is set by the user in the same manner as the case of the image processing apparatus 10. In addition, the acquiring section 72 detects the current residual amount of the battery 19. The acquiring section 72 supplies the current operation mode and the current residual amount of the battery 19 to the conversion section 74.

The storage section 73 stores an LUT where RGB values before and after color conversion which is performed in the image processing apparatus 10 are associated for each combination of an operation mode of the image processing apparatus 10, a residual amount of the battery 19, and a rise and fall of a local spatial frequency of an image (a sample image) which has an RGB value before color conversion as a pixel value.

In detail, in the LUT, each RGB value is associated with the electricity consumption minimum value where electricity consumption of the display section 18, which performs a display based on a value out of a plurality of values which are present within a predetermined distance from a value which corresponds to the RGB value in a uniform color space, is the minimum. The predetermined distance varies for each combination of an operation mode, a residual amount of the battery 19, and a rise and fall of a spatial frequency. In addition, even in the same combination, the distance varies according to whether or not the color represented by the RGB value is a blue color.

Based on feature information which is supplied from the feature extracting section 71 and the combination of the current operation mode and the residual amount of the battery 19 which are supplied from the acquiring section 72, the conversion section 74 selects an LUT of the combination from LUTs which are stored in the storage section 73. Then, the conversion section 74 converts the RGB value of each pixel of the input image into the electricity consumption minimum value based on the selected LUT.

In detail, the conversion section 74 reads out the electricity consumption minimum value which corresponds to the RGB value of each pixel of the input image from the selected LUT. Then, the conversion section 74 converts the RGB value of each pixel of the input image into the read out electricity consumption minimum value. Due to this, color conversion of the input image is performed. The conversion section 74 supplies the input image after color conversion to the display section 18 for display thereon.

Description of Processing of Image Processing Apparatus

Figure 6:
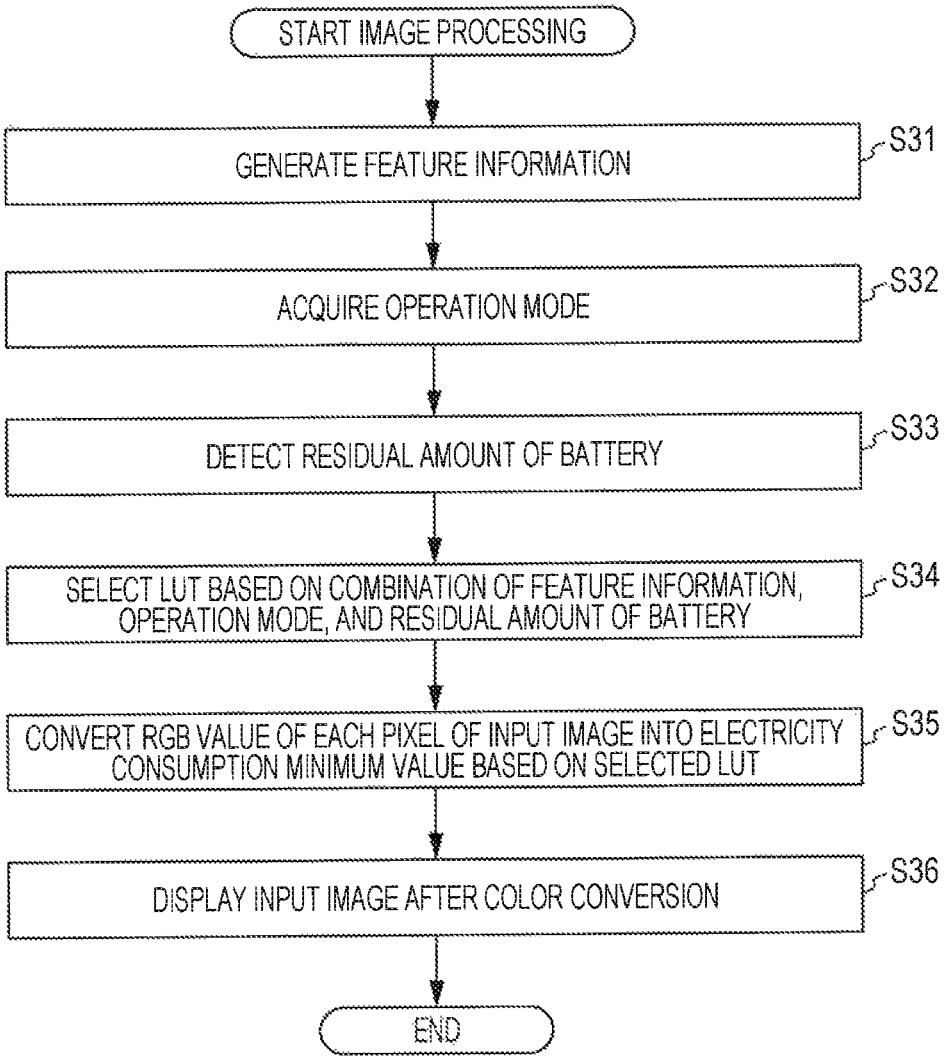
FIG. 6 is a flowchart which illustrates image processing of the image processing apparatus in FIG. 5.

FIG. 6 is a flowchart which illustrates image processing of the image processing apparatus 70 in FIG. 5.

In step S31 in FIG. 6, the feature extracting section 71 of the image processing apparatus 70 generates feature information for each pixel based on the RGB value of each pixel of the input image and supplies the result to the conversion section 74.

In step S32, the acquiring section 72 acquires the current operation mode of the image processing apparatus 70 and supplies the result to the conversion section 74. In step S33, the acquiring section 72 detects the current residual amount of the battery 19 and supplies the result to the conversion section 74.

In step S34, based on feature information which is supplied from the feature extracting section 71 and a combination of the current operation mode and the residual amount of the battery 19 which are supplied from the acquiring section 72, the conversion section 74 selects an LUT of the combination from LUTs which are stored in the storage section 73. In step S35, the conversion section 74 converts the RGB value of each pixel of the input image into the electricity consumption minimum value based on the selected LUT and supplies the result to the display section 18 as the input image after color conversion.

In step S36, the display section 18 displays the input image after color conversion.

As described above, the image processing apparatus 70 performs color conversion of the input image by converting the RGB values of the input image into the electricity consumption minimum values which correspond to the RGB values based on the LUT. Accordingly, as in the image processing apparatus 10, it is not necessary to perform color space conversion, determination of the distance ΔE', determination of the candidate of the uniform pixel value of the input image after color conversion, reverse color space conversion, determination of the electricity consumption minimum value, and the like, and it is possible to reduce the processing costs.

Here, the LUT may be associated with uniform pixel values before and after color conversion which is performed in the image processing apparatus 10. In this case, conversion of color space is performed in a front stage and a rear stage of the conversion section 74.

Third Embodiment

Description of Computer to which the Present Disclosure is Applied

The series of the processes described above are also able to be executed by hardware such as a large scale integration (LSI) and are also able to be executed by software. In a case of executing a series of processes by software, a program which configures the software is installed on a computer. Here, the term computer includes a computer which is assembled in dedicated hardware or a versatile personal computer which is, for example, able to execute various types of functions by installing various types of programs, or the like.

Figure 7:
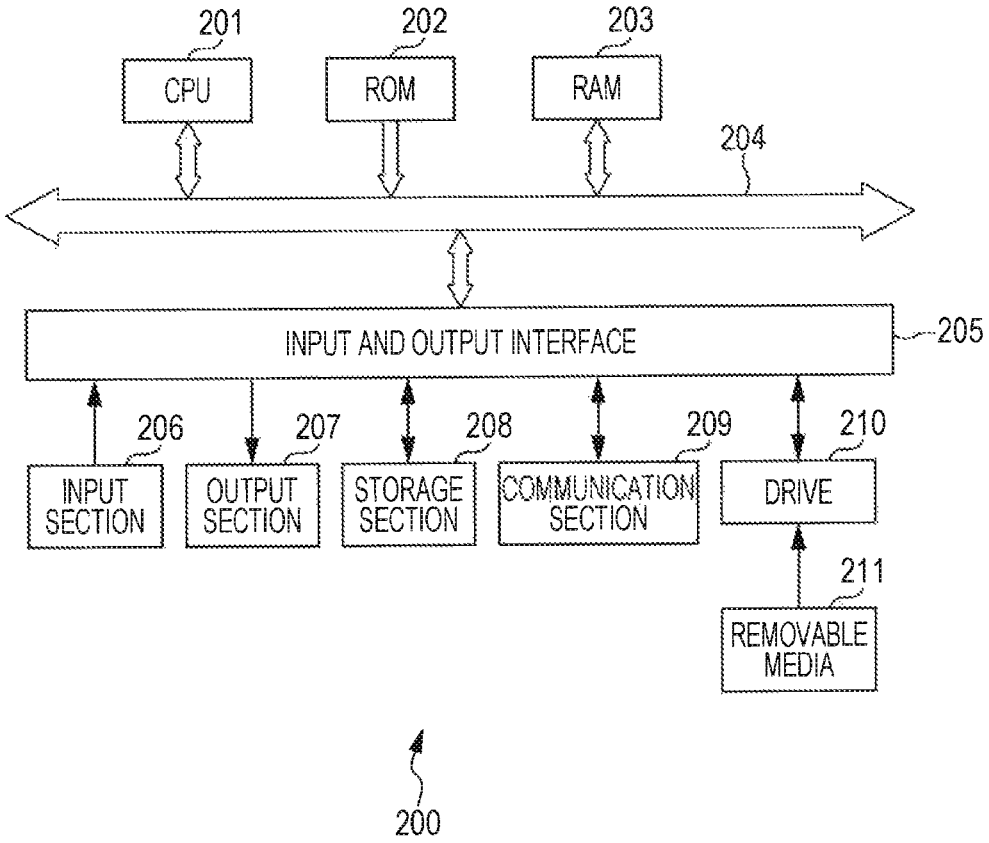
FIG. 7 is a block diagram which shows a configuration example of hardware of a computer.

FIG. 7 is a block diagram which shows a configuration example of hardware of a computer which executes the series of the processes described above using a program.

In a computer 200, a central processing unit (CPU) 201, a read only memory (ROM) 202, and a random access memory (RAM) 203 are mutually connected by a bus 204.

An input and output interface 205 is further connected with the bus 204. An input section 206, an output section 207, a storage section 208, a communication section 209, and a drive 210 are connected with the input and output interface 205.

The input section 206 is formed of a keyboard, a mouse, a microphone, and the like. The output section 207 is formed of a display, a speaker, and the like. The storage section 208 is formed of a hard disk, a non-volatile memory, or the like. The communication section 209 is formed of a network interface and the like. The drive 210 drives a removable media 211 such as a magnetic disk, an optical disc, an optical magnetic disc, or a semiconductor memory.

In the computer 200 which is configured as described above, the series of processes described above is performed, for example, by the CPU 201 executing a program which is stored in the storage section 208 by loading the program into the RAM 203 via the input and output interface 205 and the bus 204.

It is possible to provide the program executed by the computer 200 (the CPU 201) by recording the program onto the removable media 211, for example, as a package media or the like. In addition, it is possible to provide the program via a wired or wireless transmission medium such as a local area network, the Internet, or digital satellite broadcasting.

In the computer 200, it is possible to install a program in the storage section 208 via the input and output interface 205 by mounting the removable media 211 onto the drive 210. In addition, it is possible to receive a program in the communication section 209 and install the program in the storage section 208 via a wired or wireless transmission medium. Apart from these, it is possible to install a program in the ROM 202 or the storage section 208 in advance.

Here, the program executed by the computer 200 may be a program where processes are performed in time series in the order described in the present specification and may be a program where the processes are performed at a necessary timing such as when called.

In addition, in a case where the computer 200 has a graphics processing unit (CPU), the processes described above may be performed by the CPU, not the CPU 201.

Fourth Embodiment

Configuration Example of Television Apparatus

Figure 8:
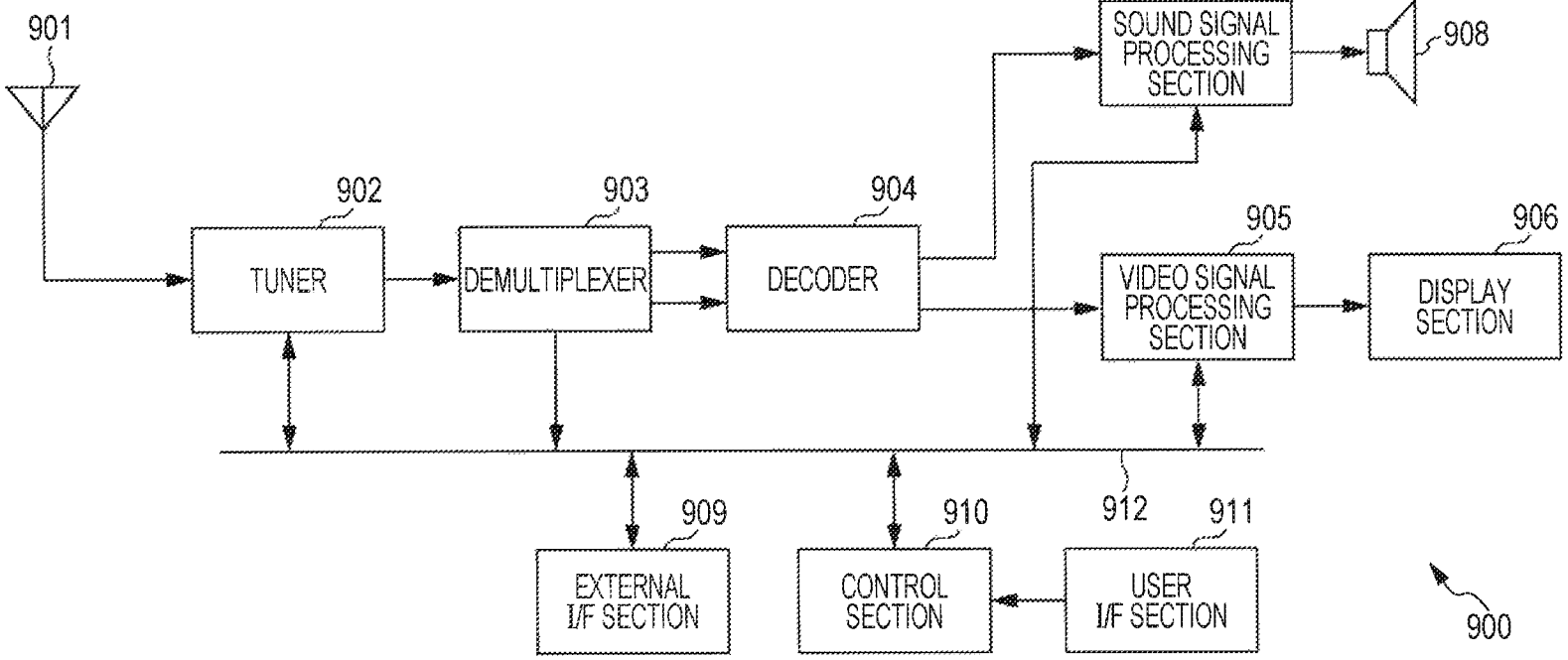
FIG. 8 is a diagram which shows a schematic configuration example of a television apparatus to which the present disclosure is applied.

FIG. 8 illustrates a schematic configuration of a television apparatus to which the present disclosure is applied. A television apparatus 900 has an antenna 901, a tuner 902, a demultiplexer 903, a decoder 904, a video signal processing section 905, a display section 906, a sound signal processing section 907, a speaker 908, and an external interface section 909. Furthermore, the television apparatus 900 has a control section 910, a user interface section 911, and the like.

The tuner 902 performs demodulation by selecting a desired channel from a broadcast wave signal which is received in the antenna 901 and outputs an obtained encoded bit stream to the demultiplexer 903.

The demultiplexer 903 extracts a packet of the video or sound of a program which is to be viewed from the encoded bit stream and outputs data of the extracted packet to the decoder 904. In addition, the demultiplexer 903 supplies a packet of data such as an electronic program guide (EPG) to the control section 910. Here, in a case where scrambling is performed, cancellation of the scrambling is performed by a demultiplexer or the like.

The decoder 904 performs a packet decoding process and outputs video data which is generated by the decoding processing to the video signal processing section 905 and outputs sound data to the sound signal processing section 907.

The video signal processing section 905 performs noise removal, video processing according to user settings, or the like with respect to the video data. The video signal processing section 905 generates video data of a TV program which is displayed on the display section 906, or image data or the like by processing based on an application which is supplied via a network. In addition, the video signal processing section 905 generates video data for displaying a menu screen or the like such as for item selection and superimposes the generated video data on the video data of the TV program. The video signal processing section 905 drives the display section 906 by generating a driving signal based on the video data which is generated in this manner.

The display section 906 drives a display device (for example, a liquid crystal display element or the like) based on a driving signal from the video signal processing section 905 and displays a video of a TV program or the like.

The sound signal processing section 907 outputs sound by carrying out a predetermined process such as noise removal with respect to the sound data and supplying the result to the speaker 908 after performing a D/A conversion process or an amplification process on the processed sound data.

The external interface section 909 is an interface for connecting an external device or a network and performs sending and receiving data such as video data or sound data.

The user interface section 911 is connected with the control section 910. The user interface section 911 is configured by an operation switch, a remote control signal receiving section, or the like and supplies an operation signal according to a user operation to the control section 910.

The control section 910 is configured using a central processing unit (CPU), a memory, or the like. A memory stores a program which is executed by a CPU, various types of data which are necessary when the CPU performs processing, EPG data, data which is acquired via a network, and the like. A program which is stored in a memory is read out and executed by a CPU at a predetermined timing, such as when the television apparatus 900 is turned on. By executing the program, the CPU controls each section such that the television apparatus 900 carries out an operation according to a user operation.

Here, a bus 912 for connecting the tuner 902, the demultiplexer 903, the video signal processing section 905, the sound signal processing section 907, the external interface section 909, and the like with the control section 910 is provided in the television apparatus 900.

In a television apparatus which is configured in this manner, the functions of the image processing apparatus (the image processing method) of the present document are provided in the video signal processing section 905. Due to this, it is possible to keep deterioration in the appearance of an image in a predetermined range in a case of reducing electricity consumption when displaying an image by color conversion.

Fifth Embodiment

Configuration Example of Mobile Phone

Figure 9:
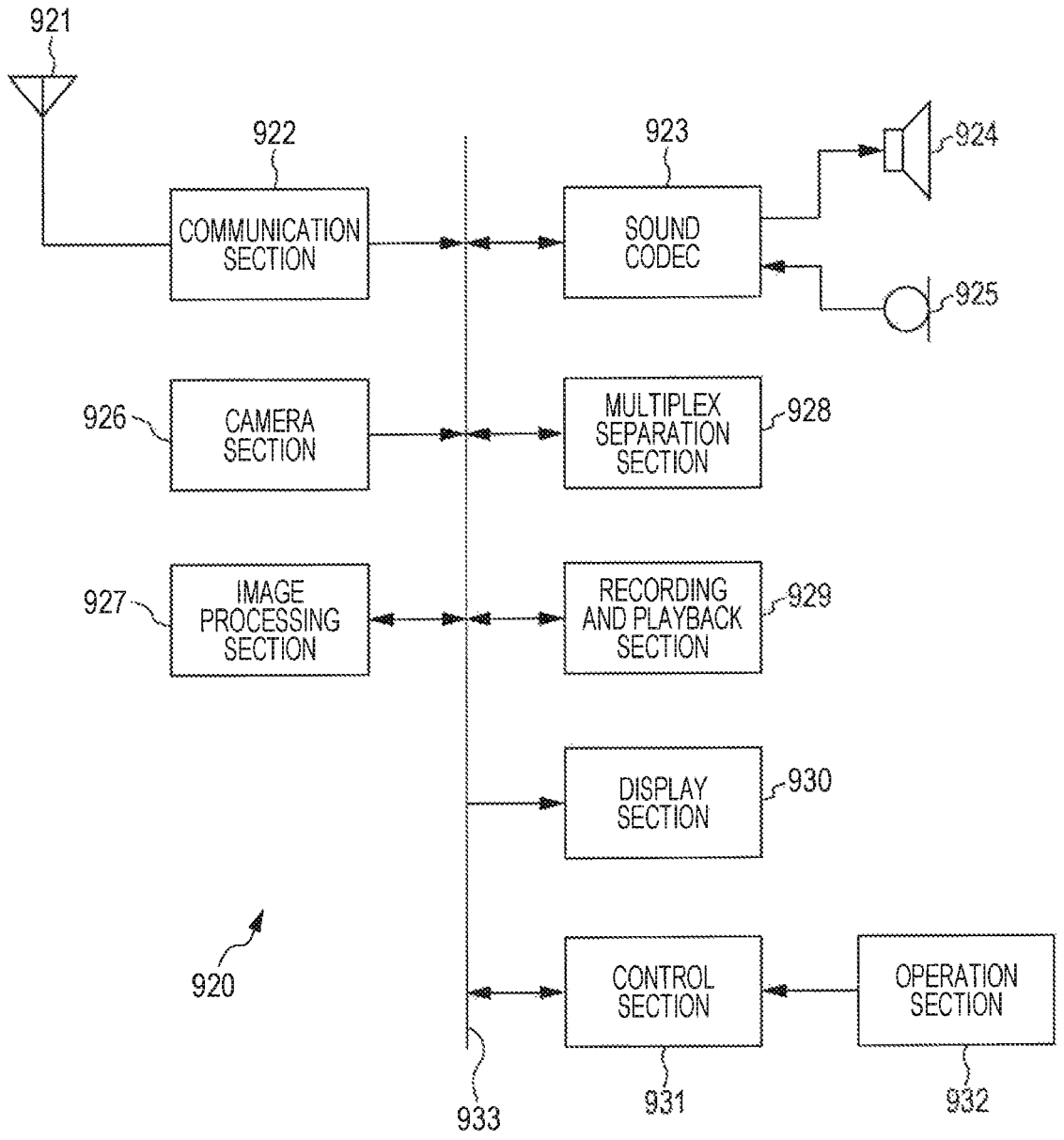
FIG. 9 is a diagram which shows a schematic configuration example of a mobile phone to which the present disclosure is applied.

FIG. 9 illustrates a schematic configuration of a mobile phone to which the present disclosure is applied. A mobile phone 920 has a communication section 922, a sound codec 923, a camera section 926, an image processing section 927, a multiplex separation section 928, a recording and playback section 929, a display section 930, and a control section 931. These are connected with each other via a bus 933.

In addition, an antenna 921 is connected with the communication section 922 and a speaker 924 and a microphone 925 are connected with the sound codec 923. Furthermore, an operation section 932 is connected with the control section 931.

The mobile phone 920 performs various types of operations such as sending and receiving sound signals, sending and receiving electronic mails or image data, imaging an image, or recording data in various types of modes such as a sound speaking mode, a data communication mode, or the like.

In a sound speaking mode, a sound signal which is generated in the microphone 925 is supplied to the communication section 922 after conversion to sound data or data compression is performed using the sound codec 923. The communication section 922 performs a modulation process, a frequency conversion process, or the like on the sound data and generates a sending signal. In addition, the communication section 922 supplies the sending signal to the antenna 921 to be sent to a base station which is not shown in the diagram. In addition, the communication section 922 performs amplification, a frequency conversion process, a demodulation process, and the like on a received signal which is received in the antenna 921 and supplies the obtained sound data to the sound codec 923. The sound codec 923 performs data expansion on the sound data or conversion into an analog sound signal and outputs the result to the speaker 924.

In addition, in a case of sending an electronic mail in a data communication mode, the control section 931 receives character data which is input by operation of the operation section 932 and displays the input characters on the display section 930. In addition, the control section 931 generates mail data based on a user instruction or the like in the operation section 932 and supplies the result to the communication section 922. The communication section 922 performs a modulation process, a frequency conversion process, or the like on the mail data and sends the obtained sending signal from the antenna 921. In addition, the communication section 922 performs amplification, a frequency conversion process, a demodulation process, and the like on the received signal which is received in the antenna 921 and restores the mail data. The mail data is supplied to the display section 930 to display the mail content.

Here, the mobile phone 920 is also able to store received mail data in a storage medium in the recording and play-back section 929. The storage medium is an arbitrary storage medium which is rewritable. For example, the storage medium is a semiconductor memory such as a RAM or a built-in type flash memory, a hard disk, a magnetic disk, an optical magnetic disc, an optical disc, or a removable media such as a universal serial bus (USB) memory or a memory card.

In a case of sending image data in a data communication mode, the image data which is generated in the camera section 926 is supplied to the image processing section 927. The image processing section 927 performs an encoding process on the image data and generates encoded data.

The multiplex separation section 928 multiplexes the encoded data which is generated in the image processing section 927 and the sound data which is supplied from the sound codec 923 by a predetermined method and supplies the result to the communication section 922. The communication section 922 performs a modulation process, a frequency conversion process, or the like on the multiplexed data and sends the obtained sending signal from the antenna 921. In addition, the communication section 922 performs amplification, a frequency conversion process, a demodulation process, and the like on the received signal which is received in the antenna 921 and restores the multiplexed data. The multiplexed data is supplied to the multiplex separation section 928. The multiplex separation section 928 separates the multiplexed data and supplies the encoded data to the image processing section 927 and supplies the sound data to the sound codec 923. The image processing section 927 performs a decoding process on the encoded data and generates image data. The image data is supplied to the display section 930 and the received image is displayed. The sound codec 923 converts the sound data into an analog sound signal, supplies the result to the speaker 924, and outputs the received sound.

In a mobile phone apparatus which is configured in this manner, the functions of the image processing apparatus (the image processing method) of the present document are provided in the image processing section 927. Due to this, it is possible to keep deterioration in the appearance of an image in a predetermined range in a case of reducing electricity consumption when displaying an image by color conversion.

Sixth Embodiment

Configuration Example of Recording and Play-Back Apparatus

Figure 10:
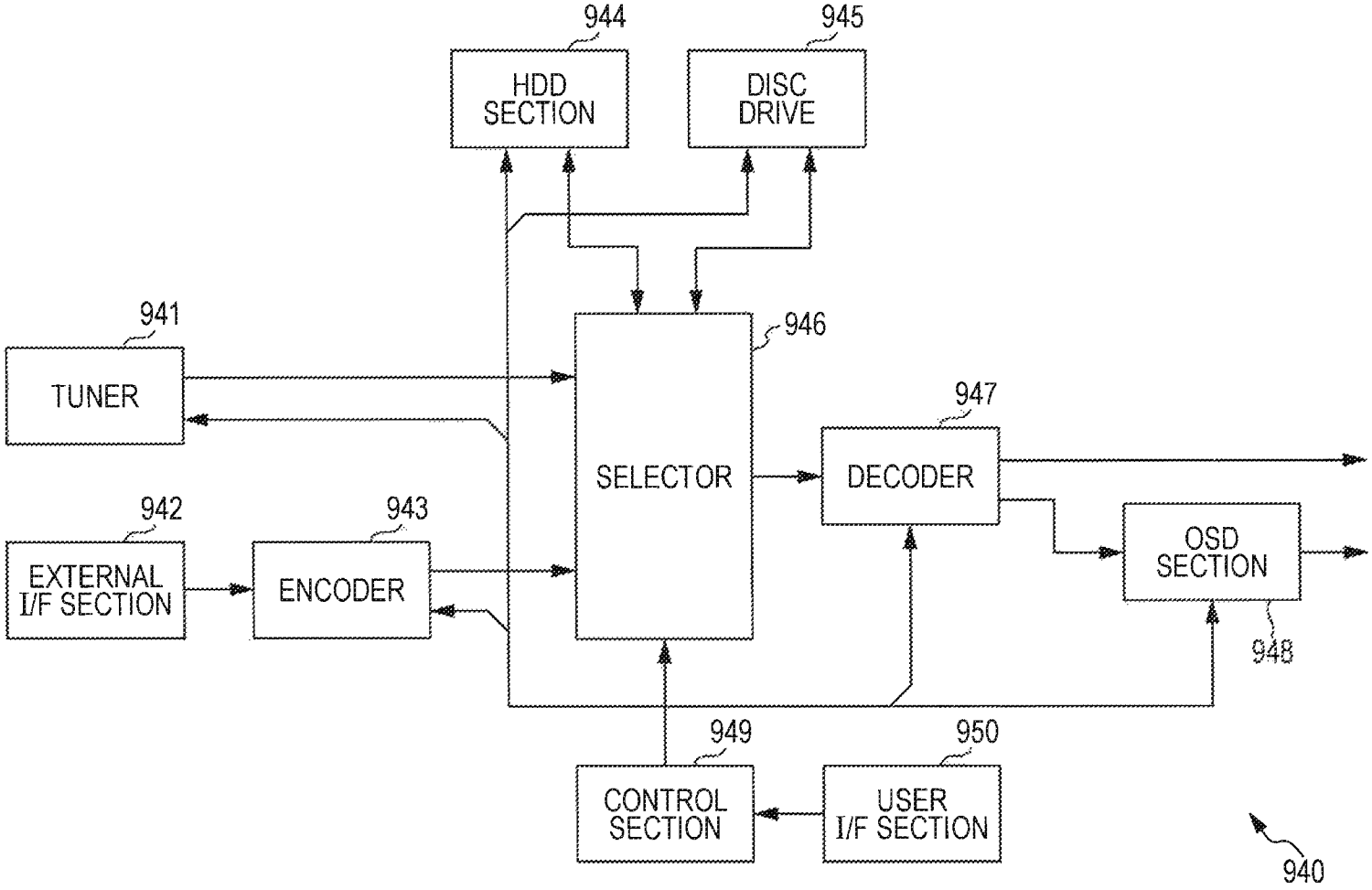
FIG. 10 is a diagram which shows a schematic configuration example of a recording and play-back apparatus to which the present disclosure is applied.
Figure 11:
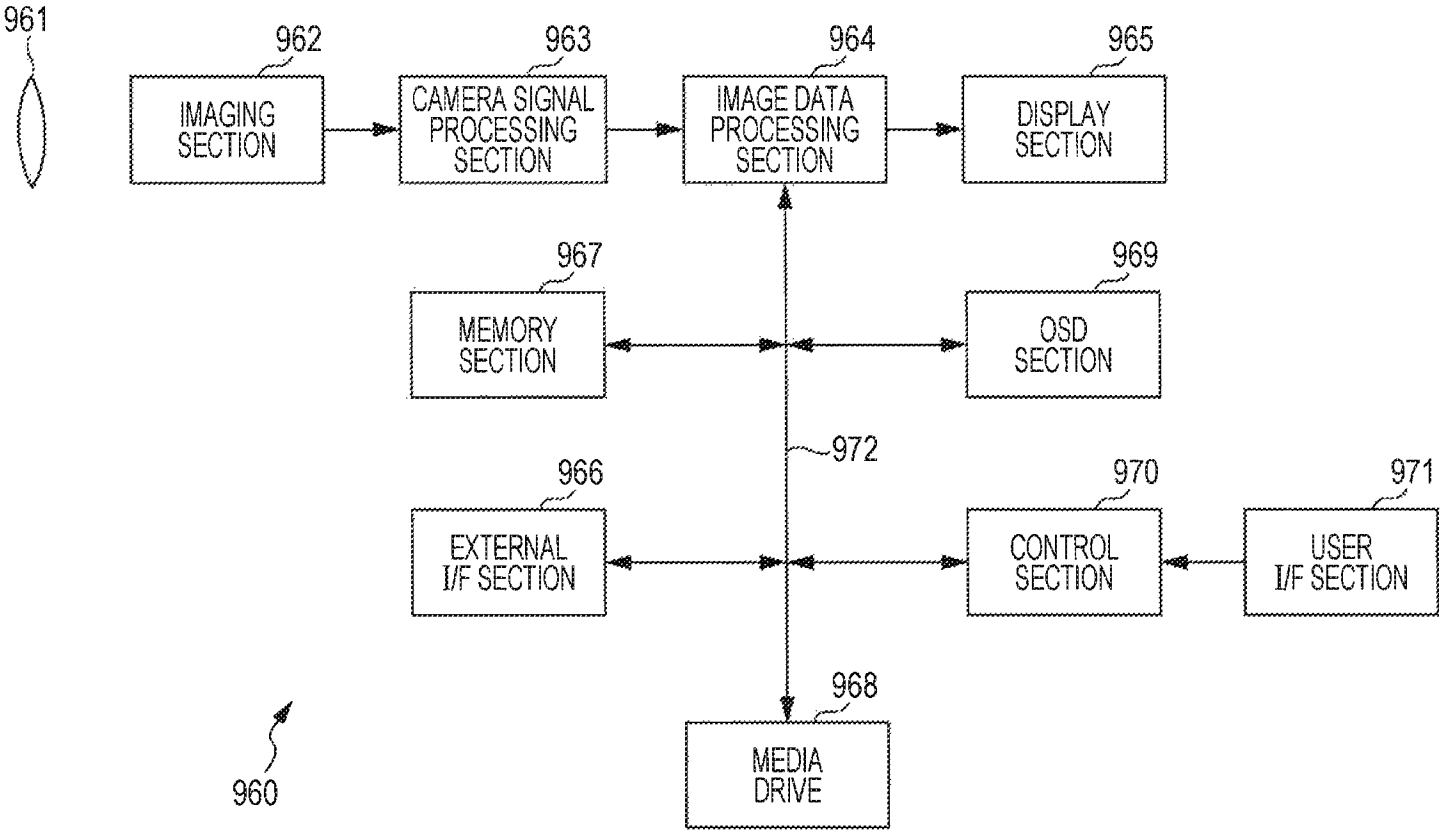
FIG. 11 is a diagram which shows a schematic configuration example of an imaging apparatus to which the present disclosure is applied.

FIG. 10 illustrates a schematic configuration of a recording and play-back apparatus to which the present disclosure is applied. A recording and play-back apparatus 940 records, for example, audio data and video data of a received broadcast program onto a recording medium and provides the recorded data to the user at a timing according to an instruction of the user. In addition, the recording and play-back apparatus 940 is, for example, able to acquire audio data or video data from another apparatus and record the acquired data onto a recording medium. Furthermore, the recording and play-back apparatus 940 is able to display an image or output sound in a monitor apparatus or the like by decoding and outputting audio data or video data which are recorded on the recording medium.

The recording and play-back apparatus 940 has a tuner 941, an external interface section 942, an encoder 943, a hard disk drive (HDD) section 944, a disk drive 945, a selector 946, a decoder 947, an on-screen display (OSD) section 948, a control section 949, and a user interface section 950.

The tuner 941 selects a desired channel from a broadcast signal which is received in an antenna which is not shown in the diagram. The tuner 941 outputs an encoded bit stream, which is obtained by demodulating a received signal of a desired channel, to the selector 946.

The external interface section 942 is configured by at least any one of an IEEE1394 interface, a network interface section, a USB interface, a flash memory interface, and the like. The external interface section 942 is an interface for connecting an external device, a network, a memory card, or the like and receives data such as video data, sound data, or the like to be recorded.

The encoder 943 performs encoding by a predetermined method when video data or sound data which is supplied from the external interface section 942 is not encoded and outputs an encoded bit stream to the selector 946.

The HDD section 944 records content data of video, sound, or the like, various types of programs, other data, or the like in a built-in hard disk and reads these out from the hard disk again during playback or the like.

The disk drive 945 records and plays back a signal with respect to an optical disc which is mounted therein. The optical disc is, for example, a DVD disc (DVD-Video, DVD-RAM, DVD-R, DVD-RW, DVD+R, DVD+RW, and the like), a Blu-ray (registered trademark) disk, or the like.

The selector 946 selects an encoded bit stream from either the tuner 941 or the encoder 943 when recording video or sound and supplies the result to either the HDD section 944 or the disk drive 945. In addition, the selector 946 supplies the encoded bit stream which is output from the HDD section 944 or the disk drive 945 to the decoder 947 when playing back the video or sound.

The decoder 947 performs a decoding process on the encoded bit stream. The decoder 947 supplies video data which is generated by performing decoding processing to the OSD section 948. In addition, the decoder 947 outputs sound data which is generated by performing decoding processing.

The OSD section 948 generates video data for displaying a menu screen or the like such as for item selection, superimposes the generated video data on the video data which is output from the decoder 947, and outputs the result.

The user interface section 950 is connected with the control section 949. The user interface section 950 is configured by an operation switch, a remote control signal receiving section, and the like and supplies an operation signal according to a user operation to the control section 949.

The control section 949 is configured using a CPU, a memory, or the like. The memory stores a program which is executed by the CPU and various types of data which are necessary when the CPU performs processing. The program which is stored in the memory is read out and executed by the CPU at a predetermined timing, such as when the recording and play-back apparatus 940 is turned on. By executing the program, the CPU controls each section such that the recording and play-back apparatus 940 carries out an operation according to a user operation.

In a recording and play-back apparatus which is configured in this mariner, the functions of the image processing apparatus (the image processing method) of the present document are provided in the decoder 947. Due to this, it is possible to keep deterioration in the appearance of an image in a predetermined range in a case of reducing electricity consumption when displaying an image by color conversion.

Seventh Embodiment

Configuration Example of Imaging Apparatus

FIG. 11 illustrates a schematic configuration of an imaging apparatus to which the present disclosure is applied. An imaging apparatus 960 images a subject, displays an image of the subject on the display section, and records this as image data on a recording medium.

The imaging apparatus 960 has an optical block 961, an imaging section 962, a camera signal processing section 963, an image data processing section 964, a display section 965, an external interface section 966, a memory section 967, a media drive 968, an OSD section 969, and a control section 970. In addition, a user interface section 971 is connected with the control section 970. Furthermore, the image data processing section 964, the external interface section 966, the memory section 967, the media drive 968, the OSD section 969, the control section 970, and the like are connected via a bus 972.

The optical block 961 is configured using a focus lens, an aperture mechanism, or the like. The optical block 961 focuses an optical image of a subject on an imaging surface of the imaging section 962. The imaging section 962 is configured using a CCD or CMOS image sensor and generates an electrical signal according to an optical image by photoelectric conversion and supplies the result to the camera signal processing section 963.

The camera signal processing section 963 performs various types of camera signal processes such as knee correction, gamma correction, color correction, or the like with respect to an electrical signal which is supplied from the imaging section 962. The camera signal processing section 963 supplies image data after camera signal processing to the image data processing section 964.

The image data processing section 964 performs an encoding process on the image data which is supplied from the camera signal processing section 963. The image data processing section 964 supplies encoded data, which is generated by performing an encoding process, to the external interface section 966 or the media drive 968. In addition, the image data processing section 964 performs a decoding process on the encoded data which is supplied from the external interface section 966 or the media drive 968. The image data processing section 964 supplies the image data which is generated by performing the decoding process to the display section 965. In addition, the image data processing section 964 performs a process which supplies image data which is supplied from the camera signal processing section 963 to the display section 965 or superimposes data for a display which is acquired from the OSD section 969 on image data and supplies the result to the display section 965.

The OSD section 969 generates data for a display such as a menu screen or icon formed of symbols, characters, or graphics and outputs the data to the image data processing section 964.

The external interface section 966 is configured, for example, by a USB input and output terminal or the like and is connected with a printer in a case of printing an image. In addition, a drive is connected with the external interface section 966 as necessary, a removable media such as a magnetic disk or an optical disc is appropriately mounted therein, and a computer program which is read out therefrom is installed as necessary. Furthermore, the external interface section 966 has a network interface which is connected with a predetermined network such as a LAN or the Internet. The control section 970 is able to read out encoded data from the media drive 968, for example, according to an instruction from the user interface section 971 and to supply the data from the external interface section 966 to another apparatus which is connected via a network. In addition, the control section 970 is able to acquire the encoded data or image data, which is supplied from another apparatus via a network, via the external interface section 966 and to supply the data to the image data processing section 964.

As the recording media which is driven in the media drive 968, for example, it is possible to use an arbitrary removable media which is readable and writable such as a magnetic disk, an optical magnetic disc, an optical disc, a semiconductor memory, or the like. In addition, the type of recording media as the removable media is arbitrary and may be a tape device, may be a disk, or may be a memory card. Naturally, the recording media may be a non-contact integrated circuit (IC) card or the like.

In addition, the recording media may be configured by a non-portable recording medium, for example, such as a built-in hard disk drive or a solid state drive (SSD) by integrating the media drive 968 and the recording media.

The control section 970 is configured using a CPU. The memory section 967 stores a program which is executed by the control section 970, various types of data which are necessary when the control section 970 performs processing, or the like. The program which is stored in the memory section 967 is read out and executed by the control section 970 at a predetermined timing such as when the imaging apparatus 960 is turned on. By executing the program, the control section 970 controls each section such that the imaging apparatus 960 carries out an operation according to a user operation.

In an imaging apparatus which is configured in this manner, the functions of the image processing apparatus (the image processing method) of the present document are provided in the image data processing section 964. Due to this, it is possible to keep deterioration in the appearance of an image in a predetermined range in a case of reducing electricity consumption when displaying an image by color conversion.

Here, the effects described in the present specification are merely illustrative and are not limited to the description, and there may be other effects.

In addition, embodiments of the present disclosure are not limited to the embodiments described above and various types of changes are possible within a range which does not depart from the gist of embodiments of the present disclosure.

For example, the present disclosure is able to adopt a cloud computing configuration in which one function is shared between and processed in a plurality of apparatuses via a network.

In addition, in addition to execution in one apparatus, it is possible to execute each of the steps described in the flowchart described above by sharing the steps in a plurality of apparatuses.

Furthermore, in a case where a plurality of processes are included in one step, in addition to execution in one apparatus, it is possible to share and execute the plurality of the processes which are included in the one step in a plurality of apparatuses.

In addition, it is also possible for the present disclosure to adopt the following configurations.

(1) An image processing apparatus including a selection section which selects an electricity consumption minimum value where electricity consumption of a display section, which performs a display based on a value out of a plurality of values which are present within a predetermined distance from a pixel value of an image in a uniform color space, is a minimum as a pixel value of the image after color conversion, to generate an image after the color conversion.

(2) The image processing apparatus according to (1), further including a determination section which determines the predetermined distance based on a feature of the image.

(3) The image processing apparatus according to in which the determination section is configured so as to determine the predetermined distance based on a color which a pixel value of the image represents.

(4) The image processing apparatus according to (2) or (3), in which the determination section is configured so as to determine the predetermined distance based on a spatial frequency of the image.

(5) The image processing apparatus according to any one of (2) to (4), in which the determination section is configured so as to determine the predetermined distance in a block unit formed of a plurality of pixels of the image.

(6) The image processing apparatus according to any one of (1) to (5), further including a determination section which determines the predetermined distance based on an operation mode.

(7) The image processing apparatus according to any one of (1) to (6), further including a determination section which determines the predetermined distance based on a residual amount of a battery which supplies electrical power to the display section which displays the image after the color conversion which is generated by the selection section.

(8) The image processing apparatus according to any one of (1) to (7), in which the selection section is configured so as to select a pixel value of the image after the color conversion based on electricity consumption information which represents a relationship between a value of a uniform color space and electricity consumption of the display section which performs a display based on the value of the uniform color space.

(9) The image processing apparatus according to (8), further including an acquiring section which acquires the electricity consumption information from the display section, in which the selection section is configured so as to select the pixel value of the image after the color conversion based on the electricity consumption information which is acquired by the acquiring section.

(10) The image processing apparatus according to (8), further including a storage section which stores the electricity consumption information, in which the selection section is configured so as to select the pixel value of the image after the color conversion based on the electricity consumption information which is stored by the storage section.

(11) An image processing method including causing an image processing apparatus to select an electricity consumption minimum value where electricity consumption of a display section, which performs a display based on a value out of a plurality of values which are present within a predetermined distance from a pixel value of an image in a uniform color space, is a minimum as a pixel value of the image after color conversion, to generate an image after the color conversion.

(12) A program including causing a computer to execute a function as a selection section which selects an electricity consumption minimum value where electricity consumption of a display section, which performs a display based on a value out of a plurality of values which are present within a predetermined distance from a pixel value of an image in a uniform color space, is a minimum as a pixel value of the image after color conversion, to generate an image alter the color conversion.

(13) An image processing apparatus including a conversion section which performs color conversion of an image by converting a pixel value of each pixel of the image into an electricity consumption minimum value which corresponds to the pixel value based on a table where an electricity consumption minimum value where electricity consumption of a display section, which performs a display based on a value out of a plurality of values which are present within a predetermined distance from a predetermined value in a uniform color space, is a minimum is associated with the predetermined value.

(14) The image processing apparatus according to (13), in which the predetermined distance is determined based on a color which the predetermined value represents.

(15) The image processing apparatus according to (13) or (14), in which the table is generated such that the predetermined distance is different for each spatial frequency of a sample image which is an image which has the predetermined value as a pixel value, and the conversion section performs the color conversion based on the table which corresponds to the spatial frequency of the image.

(16) The image processing apparatus according to any one of (13) to (15), in which the table is generated such that the predetermined distance is different for each operation mode, and the conversion section performs the color conversion based on the table which corresponds to a current operation mode.

(17) The image processing apparatus according to any one of (13) to (16), in which the table is generated such that the predetermined distance is different for each residual amount of a battery which supplies electrical power to a display section which displays the image after the color conversion by the conversion section, and the conversion section performs the color conversion based on the table which corresponds to a current residual amount of the battery.

(18) An image processing method including converting where an image processing apparatus performs color conversion of an image by converting a pixel value of each pixel of the image into an electricity consumption minimum value which corresponds to the pixel value based on a table where an electricity consumption minimum value where electricity consumption of a display section, which performs a display based on a value out of a plurality of values which are present within a predetermined distance from a predetermined value of an image in a uniform color space, is a minimum is associated with the predetermined value.

(19) A program including causing a computer to execute a function as a conversion section which performs color conversion of an image by converting a pixel value of each pixel of the image into an electricity consumption minimum value which corresponds to the pixel value based on a table where an electricity consumption minimum value where electricity consumption of a display section, which performs a display based on a value out of a plurality of values which are present within a predetermined distance from a predetermined value in a uniform color space, is a minimum is associated with the predetermined value.

It should be understood by those skilled in the art that various modifications, combinations, sub-combinations and alterations may occur depending on design requirements and other factors insofar as they are within the scope of the appended claims or the equivalents thereof.

What is claimed is:

1. An image processing apparatus comprising:

circuitry configured to determine a distance between potential candidate pixel values of a uniform pixel value after color conversion and an actual pixel value out of a plurality of pixel values of an input image before color conversion in a uniform color space, wherein an amount of the distance is determined for all pixels of a plurality of pixels forming a block based on a combination of a spatial frequency of a region centering on one pixel of the plurality of pixels forming the block, an operation mode of the image processing apparatus, and a residual amount of a battery used to supply electrical power to a display associated with the image processing apparatus;

select an electricity consumption minimum pixel value from the potential candidate pixel values within the determined distance from each actual pixel value before conversion in the uniform color space based on electricity consumption information acquired for the display, which is controlled by the circuitry to perform display based on the selected electricity consumption minimum pixel value out of the plurality of pixel values within the determined distance from each actual pixel value of the input image in the uniform color space for each particular pixel being used as a converted pixel value for each actual pixel, in order to generate an output image after color conversion, wherein the operation mode of the image processing apparatus is set by a user of the image processing apparatus and indicates an overall level of reduction in electricity consumption for the image processing apparatus, and wherein, for each block of the input image, the circuitry determines the distance as a single distance for all the pixels of the plurality of pixels forming the block.

2. The image processing apparatus according to claim 1, wherein the circuitry is further configured to determine the distance based on a feature of each actual pixel value.

3. The image processing apparatus according to claim 2, wherein the circuitry is further configured to determine the spatial frequency based on a color which each actual pixel value of the input image represents.

4. The image processing apparatus according to claim 3, wherein the circuitry is further configured to determine the distance to be shorter when the color of an actual pixel value is blue.

5. The image processing apparatus according to claim 1, wherein the circuitry is further configured to store the acquired electricity consumption information, and select the pixel value of the output image after the color conversion based on the stored electricity consumption information.

6. The image processing apparatus according to claim 1, wherein the circuitry determines the single distance for all the pixels of the plurality of pixels forming each particular block of the input image based on the spatial frequency of a region centering on one pixel in a center of the particular block.

7. An image processing method, performed via at least one processor, the method comprising:

determining a distance between potential candidate pixel values of a uniform pixel value after color conversion and an actual pixel value out of a plurality of pixel values of an input image before color conversion in a uniform color space, wherein an amount of the distance is determined for all pixels of a plurality of pixels forming a block based on a combination of a spatial frequency of a region centering on one pixel of the plurality of pixels forming the block, an operation mode of an image processing apparatus and a residual amount of a battery used to supply power to a display associated with the image processing apparatus;

selecting an electricity consumption minimum pixel value from the potential candidate pixel values within the determined distance from each actual pixel value before conversion in the uniform color space based on electricity consumption information acquired for the display, which is controlled by the at least one processor to perform display based on the selected electricity consumption minimum pixel value out of the plurality of pixel values within the determined distance from each actual pixel value of the input image in the uniform color space for each particular pixel being used as a converted pixel value for each actual pixel, in order to generate an output image after color conversion, wherein the operation mode of the image processing apparatus is set by a user of the image processing apparatus and indicates an overall level of reduction in electricity consumption for the image processing apparatus, and wherein, for each block of the input image, the distance is determined as a single distance for all the pixels of the plurality of pixels forming the block.

8. A non-transitory computer-readable storage medium having embodied thereon a program, which when executed by a computer, causes the computer to execute a method, the method comprising:

determining a distance between potential candidate pixel values of a uniform pixel value after color conversion and an actual pixel value out of a plurality of pixel values of an input image before color conversion in a uniform color space, wherein an amount of the distance is determined for all pixels of a plurality of pixels forming a block based on a combination of a spatial frequency of a region centering on one pixel of the plurality of pixels forming the block, an operation mode of an image processing apparatus and a residual amount of a battery used to supply power to a display associated with the image processing apparatus;

selecting an electricity consumption minimum pixel value from the potential candidate pixel values within the determined distance from each actual pixel value before conversion in the uniform color space based on electricity consumption information acquired for the display, which is controlled by the computer to perform display based on the selected electricity consumption minimum pixel value out of the plurality of pixel values within the determined distance from each actual pixel value of the input image in the uniform color space for each actual pixel being used as a converted pixel value in order to generate an output image after color conversion, wherein the operation mode of the image processing apparatus is set by a user of the image processing apparatus and indicates an overall level of reduction in electricity consumption for the image processing apparatus, and wherein, for each block of the input image, the distance is determined as a single distance for all the pixels of the plurality of pixels forming the block.

9. An image processing apparatus comprising:

circuitry configured to determine a distance between potential candidate pixel values of a uniform pixel value after color conversion and an actual pixel value out of a plurality of pixel values of an input image before color conversion in a uniform color space, wherein an amount of the distance is determined for all pixels of a plurality of pixels forming a block based on a combination of a spatial frequency of a region centering on one pixel of the plurality of pixels forming the block, an operation mode of the image processing apparatus and a residual amount of a battery used to supply electrical power to a display associated with the image processing apparatus;

perform color conversion of the input image by converting the actual pixel value of each pixel of the input image into an electricity consumption minimum pixel value which corresponds to the actual pixel value based on a table where the electricity consumption minimum pixel value within the table is based on electricity consumption information acquired for the display, which is controlled by the circuitry to perform display based on the corresponding electricity consumption minimum pixel value out of the plurality of pixel values within the determined distance from each actual pixel value in the uniform color space for each actual pixel, in order to generate an output image after color conversion, wherein the operation mode of the image processing apparatus is set by a user of the image processing apparatus and indicates an overall level of reduction in electricity consumption for the image processing apparatus, and wherein, for each block of the input image, the distance is determined as a single distance for all the pixels of the plurality of pixels forming the block.

10. The image processing apparatus according to claim 9, wherein the spatial frequency is determined based on a color which each actual pixel value represents.

11. The image processing apparatus according to claim 9, wherein the table is generated such that the distance is different for each spatial frequency of the input image which has the actual pixel value, and the circuitry is further configured to perform the color conversion based on the table which corresponds to the spatial frequency of each actual pixel value of the input image.

12. The image processing apparatus according to claim 9, wherein the table is generated such that the determined distance is different for each operation mode of the image processing apparatus, and the circuitry is further configured to perform the color conversion based on the table which corresponds to a current operation mode.

13. The image processing apparatus according to claim 9, wherein the table is generated such that the determined distance is different for each residual amount of a battery which supplies electrical power to a display section which displays the image after the color conversion by the conversion section, and the circuitry is further configured to perform the color conversion based on the table which corresponds to a current residual amount of the battery.

14. An image processing method, performed via at least one processor, the method comprising:

determining a distance between potential candidate pixel values of a uniform pixel value after color conversion and an actual pixel value out of a plurality of pixel values of an input image before color conversion in a uniform color space, wherein an amount of the distance is determined for all pixels of a plurality of pixels forming a block based on a combination of a spatial frequency of a region centering on one pixel of the plurality of pixels forming the block, an operation mode of an image processing apparatus and a residual amount of a battery used to supply power to a display associated with the image processing apparatus;

performing color conversion of the input image by converting an actual pixel value of each pixel of the input image into an electricity consumption minimum pixel value which corresponds to the actual pixel value based on a table where the electricity consumption minimum pixel value within the table is based on electricity consumption information acquired for the display which is controlled by the at least one processor to perform a display based on the corresponding electricity consumption minimum pixel value out of the plurality of pixel values within the determined distance from each actual pixel value in a uniform color space for each actual pixel, in order to generate an output image after color conversion, wherein the operation mode of the image processing apparatus is set by a user of the image processing apparatus and indicates an overall level of reduction in electricity consumption for the image processing apparatus, and wherein, for each block of the input image, the distance is determined as a single distance for all the pixels of the plurality of pixels forming the block.

15. A non-transitory computer-readable storage medium having embodied thereon a program, which when executed by a computer, causes the computer to execute a method, the method comprising:

determining a distance between potential candidate pixel values of a uniform pixel value after color conversion and an actual pixel value out of a plurality of pixel values of an input image before color conversion in a uniform color space, wherein an amount of the distance is determined for all pixels of a plurality of pixels forming a block based on a combination of a spatial frequency of a region centering on one pixel of the plurality of pixels forming the block, an operation mode of an image processing apparatus and a residual amount of a battery used to supply power to a display associated with the image processing apparatus;

performing color conversion of the input image by converting an actual pixel value of each pixel of the input image into an electricity consumption minimum pixel value which corresponds to the actual pixel value based on a table where the electricity consumption minimum pixel value within the table is based on electricity consumption information acquired for the display, which is controlled by the computer to perform display based on the corresponding electricity consumption minimum pixel value out of the plurality of pixel values within the determined distance from each actual value in the uniform color space, in order to generate an output image after color conversion, wherein the operation mode of the image processing apparatus is set by a user of the image processing apparatus and indicates an overall level of reduction in electricity consumption for the image processing apparatus, and wherein, for each block of the input image, the distance is determined as a single distance for all the pixels of the plurality of pixels forming the block.

* * * * *